US005169264A

United States Patent [19]

Kimura

[11] Patent Number: 5,169,264

[45] Date of Patent: Dec. 8, 1992

[54] PROPULSION PROCESS OF BURIED PIPE

[75] Inventor: Koichi Kimura, Hyogo, Japan

[73] Assignee: Kidoh Technical Ins. Co., Ltd., Hyogo, Japan

[21] Appl. No.: 888,327

[22] Filed: May 26, 1992

Related U.S. Application Data

[63] Continuation of Ser. No. 679,969, Apr. 3, 1991, abandoned.

[30] Foreign Application Priority Data

Apr. 5, 1990 [JP] Japan ..... 2-091863

[51] Int. Cl.[5] ..... E21D 11/00; F16L 7/00

[52] U.S. Cl. ..... 405/184; 405/142; 405/146; 175/62

[58] Field of Search ..... 405/142, 146, 154, 156, 405/174, 184; 175/62

[56] References Cited

U.S. PATENT DOCUMENTS

| | | | |
|---|---|---|---|
| 3,250,077 | 5/1966 | Ede | 405/156 |
| 3,251,332 | 5/1966 | Vassar | 405/156 X |
| 3,402,781 | 9/1968 | Sandberg | 175/62 X |
| 3,762,174 | 10/1973 | Fiske et al. | 405/184 |
| 3,935,910 | 3/1976 | Gaudy et al. . | |
| 4,024,721 | 5/1977 | Takada et al. | 175/62 X |
| 4,285,613 | 8/1981 | Takagishi et al. | 405/156 |
| 4,576,515 | 3/1986 | Morimoto et al. | 405/184 |
| 4,936,709 | 6/1990 | Kimura | 405/184 |

FOREIGN PATENT DOCUMENTS

| | | | |
|---|---|---|---|
| 103886 | 3/1984 | European Pat. Off. | 405/184 |
| 345945 | 12/1989 | European Pat. Off. . | |
| 1189492 | 3/1965 | Fed. Rep. of Germany . | |
| 3306047 | 8/1984 | Fed. Rep. of Germany | 405/184 |
| 2488937 | 2/1982 | France . | |
| 2-144498 | 6/1990 | Japan . | |
| 3-47396 | 2/1991 | Japan . | |
| 3-103529 | 4/1991 | Japan . | |
| 2053326 | 2/1981 | United Kingdom . | |
| 2186899 | 8/1987 | United Kingdom . | |

*Primary Examiner*—Randolph A. Reese
*Assistant Examiner*—John A. Ricci
*Attorney, Agent, or Firm*—Nikaido, Marmelstein, Murray & Oram

[57] ABSTRACT

In a propulsion process of buried pipe, an endless pipe to be buried is formed by sequentially curving a pipe material of long hoop shape made of a plastic material, and this endless pipe is successively inserted and propelled into the burying hole while forming the burying hole by propelling a leader in the ground.

2 Claims, 4 Drawing Sheets

PROPULSION PROCESS OF BURIED PIPE

This application is a continuation of application Ser. No. 679,969 filed Apr. 3, 1991, now abandoned.

BACKGROUND OF THE INVENTION

The present invention relates to a propulsion process of buried pipe, and more particularly to a so-called propulsion process for burying an underground pipe such as a sewer without excavating the soil from the ground surface, by forming a burying hole horizontally in the soil from a shaft, and propelling while sequentially burying the pipe in the formed burying hole.

Because the propulsion method is not necessary to excavate the ground widely along the burying route, the propulsion method is intensively researched and developed as a method favorable for the installation site where the traffic volume is large and it is difficult to limit the traffic.

In the general conventional propulsion method, first a shaft is excavated and formed in the ground, and a burying hole in the horizontal direction is formed from the side of this shaft into the ground, by a device called the leader. The burying hole is formed by digging the ground by an earth auger or other digging means attached to the leader, or by compacting the ground at the conical tip portion of the leader, and either method is selected depending on the soil properties and installation conditions.

At the rear part of the leader, a buried pipe cut in a specific length is connected. The buried pipes of specific length are coupled one after another and extended in length. At the rear end of the first buried pipe or the extended buried pipe row, propelling force is applied by a jack installed in the shaft to propel the buried pipe row and the leader, while the burying hole is formed and buried pipe is installed by the leader.

The reason of using buried pipes for specific length in the propulsion process is that the handling length of the buried pipe is limited depending on the space of the shaft in order to propel prefabricated pipes into the burying hole through the shaft. Besides, to transport the pipes from the pipe mill to the site of installation and store them, it is necessary to use pipes of fixed size.

The seam of the buried pipes of specific length is connected by butt-to-butt adhesion of the pipe ends, or fitting the pipe end to the collar. In the case of collar fitting, a water stop rubber is set on the abutting face of the pipe and collar to prevent invasion of ground water.

In such a conventional propulsion process, however, the working of the seam of the pipes is difficult, and the watertightness at the seam is inferior, and the strength is not sufficient.

That is, every time one pipe is propelled into the burying hole, the next pipe must be joined to the preceding pipe, and it takes time until the pipe ends adhere sufficiently, or when fitting by a collar with water stop rubber, it must be handled carefully so as not to damage the rubber, and the work is very complicated and laborious. Since these jobs are manually done in a narrow shaft at the site, the finishing quality differs with the skill of the workers, and the pipe seam may not be joined completely, the water stopping property may not be exhibited fully, or the strength is often lowered.

Besides, in the seam part, since the strength is weaker than that of the pipe main body, and when the propulsion force from the jack or the frictional drag force from the ground is applied while propelling, the seam adhesion may be separated, the collar and the water stop rubber may be separated, or the end of the buried pipe may be broken.

If the seam junction is imperfect, ground water or sand may enter the buried pipe, or the planned water flow of the pipe may not be obtained when used as the sewer, or the water matter flowing in the pipe may lead into the ground to induce pollution problems.

Particularly, in the conventional propulsion process, a propulsion force is applied to the rear end of the buried pipe row, and all the buried pipes and the leader are propelled by this propulsion force, and an extremely large stress is concentrated on the seam of pipes, which leads to various problems as mentioned above.

SUMMARY OF THE INVENTION

It is hence a primary object of the invention to present a propulsion process of buried pipe by eliminating the seam of buried pipes in order to solve the problems in the conventional propulsion process, so that the problems of water leak, lowering of strength and others due to imperfect seam junction may be solved at the same time.

To achieve the above object, the first invention presents a propulsion process of buried pipe comprising the steps of forming a burying hole by propelling the leader in the ground, and propelling and burying the pipe in the burying hole, wherein a long hoop-shaped pipe material made of an elastic material is sequentially curved to joint the side end to form an endless pipe, and this endless pipe is successively inserted and propelled into the burying hole.

The same leader as used in the conventional propulsion process may be used. As stated above, the leader is available in various types, that is, the type having an earth auger or other digging means, the type having a tip for compaction, and the combined type, and any type may be used. In a different type, for example, muddy water is supplied and circulated from the leader into the ground, and the excavated soil is discharged together with the muddy water. When the leader is provided with a direction changing means such as a direction control jack for changing the direction of the tip, the direction of the burying hole may be easily corrected. The practical structure of this direction change means may be same as in the conventional leader.

In the invention, as the buried pipe, cylindrical tubes of fixed size are not prefabricated as in the conventional propulsion process, but an endless pipe is fabricated at the site by using pipe material, and is propelled and buried simultaneously.

The buried pipe material is a plastic material such as polyethylene and vinyl chloride, which is continuously formed in a long hoop shape and is prepared in coil form to be presented for transportation and storage. The width of the buried pipe material is adjusted to the circumferential length of the burying hole, that is, the endless buried pipe. When composing one endless buried pipe by combining a plurality of buried pipe materials, the width of one pipe material may be a portion of the circumferential length of the endless buried pipe divided by the number of pieces. Alternatively, the pipe material prefabricated in a specific width may be cut to a required width at the site by matching with the diameter of the burying hole. As the buried pipe material, any plastic material may be used as far as it is plastic enough to curve in a cylindrical form at ordinary temperature or in a heated state, and mechanically strong and durable enough to use as a buried pipe in an installed state. To adhere when forming an endless buried pipe, an adhesive material or a heat-adhesive material may be used.

To curve a hoop-shaped pipe material into a cylindrical form, the invention uses an extrusion process, drawing process, press process or other curve processing means conventionally employed in the curving process of a synthetic resin plate or a thin metal sheet. For example, when a pipe material is sent in between a drum-shaped roller having an arc-shaped curvature and a spherical roller having a spherical surface corresponding to the curvature, and is pressed and formed, the pipe material may be curved in an arc form. Alternatively by passing the pipe material into a ring-shaped curvature processing frame, the pipe material may be curved at the ratio of curvature to the inside diameter of the curvature processing frame. For the ease of pipe curving work, the pipe material may be temporarily softened by heating or other means.

As the buried pipe material, either one pipe material may be curved to compose the entire circumference of the endless buried pipe, or plural pipe materials may be joined in the circumferential direction to compose the endless buried pipe.

After curving the pipe material into a cylindrical form, the side end in the longitudinal direction is joined to form an endless buried pipe. The means for joining the side ends of the pipe material may include, among others, adhesion by adhesive, heating and fusing, welding by resin welding material, ultrasonic pressure-bonding, and ordinary joining means for synthetic resins. Since the side ends in the longitudinal direction are joined while feeding the pipe material continuously, a continuous working method should be employed as the joining means.

Thus fabricated endless pipe is propelled into the burying hole. In the invention, since the propulsion is promoted while manufacturing the endless pipe continuously from the pipe material, it is difficult to apply a large propulsion force to the rear end of the buried pipe by a jack. Accordingly, in the invention, an axial propulsion support is coupled behind the leader, and the propulsion force by the jack is applied to the rear end of this propulsion support, thereby propelling the leader.

The propulsion support is formed in a fixed length, in a cylindrical form smaller than the inside diameter of the endless pipe to be buried. The length of the propulsion support is determined in consideration of the convenience of transportation, storage and handling in the shaft. The propulsion support is linked behind the leader and is successively extended.

The propulsion support contains, in its inside, an auger screw for driving the earth auger of the leader to send out the excavated soil behind, hydraulic and pneumatic pipings for actuating the direction change means of the leader, power cable and others. In the case of a propulsion support for buried pipes of large diameter, a worker's space may be provided inside the propulsion support.

To propel the endless buried pipe, if the ground resistance is small, the endless buried pipe consecutive to the front end of the buried pipe material may be propelled by the supply means such as a roller which is used when continuously curving the pipe material, or the endless buried pipe may be propelled by pulling with the leader propelled by the propulsion support while fixing the front end of the endless buried pipe behind the leader, but if the ground resistance is large or in the case of continuous propulsion for a long distance, in order to avoid excessive stress on the endless buried pipe, it is desired to use the method of the second invention as described below.

That is, in the second invention, an endless buried pipe is inserted into the outer circumference of a propulsion support which is successively linked behind the leader, and the endless buried pipe is held and fixed on the propulsion support, and the propulsion force is transmitted from the propulsion support to the endless buried pipe.

The holding and fixing means may fix the endless buried pipe on the propulsion support, in the state of the endless buried pipe being inserted in the outer circumference of the propulsion support, by holding from the inside of the endless buried pipe, while resisting the frictional drag force applied to the buried pipe from the ground when propelling. Practically, for example, an inflating piece made of rubber bag or the like which is inflated by the supply of pressure medium such as air is disposed on the outer circumference of the propulsion support, and this inflating piece is inflated to press against the inner wall of the endless buried pipe, so that the endless buried pipe is held and fixed on the inflating piece by the frictional support force between the inflating piece and the endless buried pipe. Alternatively, a friction holding plate for pressing the inside of the buried pipe by mechanically moving from the outer circumference of the propulsion support to the endless buried pipe side may be disposed, or a proper stopping concave or convex part is formed inside the endless buried pipe, and an engaging member to be engaged with the stopping concave or convex part is placed on the propulsion support, or other holding mechanism or fixing mechanical in various machines may be applied.

As a practical structure of such a holding and fixing means, the technology disclosed in the present inventors' previous Japanese Patent Applications No. 63-298619, No. 1-183271 and No. 1-240408 may be applied.

The propulsion process employing the constituent members of the structure described above is explained below.

In the ground of the burying route of the pipes, shafts are excavated at proper intervals, and the lead is propelled from the side wall of the shaft into the ground to form a burying hole, which is the same as in the ordinary propulsion process. In the invention, however, pipes of fixed length are not connected in succession behind the leader, but an endless pipe is manufactured continuously from a pipe material and is sent into the burying hole successively. The pipe material and the equipment for manufacturing an endless pipe from the pipe material are usually placed in the shaft, but part of the equipment may be placed on the ground.

Behind the leader, the propulsion support is linked and extended sequentially. The propulsion support is linked to the leader through the endless pipe being manufactured continuously. If necessary, the front end of the endless buried pipe is fixed to the leader. When holding and fixing the endless buried pipe to the propulsion support, the holding and fixing means is manipulated while sequentially coupling the propulsion support, and the endless buried pipe of that portion is held and fixed.

In this state, a propulsion force is applied to the propulsion support by a jack or the like. The propulsion force applied to the propulsion support is transmitted sequentially to the forward propulsion support and the foremost leader, and is transmitted to the endless buried pipe through the holding and fixing means of the leader.

By working continuously in this way, the burying hole is formed and the endless pipe is propelled and buried by the leader. In the invention, meanwhile, it is not necessary to couple and join every pipe as required in the prior art.

When the leader is propelled to the intended shaft, the leader and the propulsion support are removed from the burying hole, and only the endless buried pipe is left in the burying hole. The propulsion supports are mutually released, and the propulsion supports of specific length are sequentially removed from the burying hole and the shaft. At the same time, holding or fixing of the endless buried pipe by the holding and fixing means is also released sequentially. The rear end part of the endless buried pipe is consecutive to the buried pipe material, and the endless pipe is cut off at a proper position to be separated from the buried pipe material, and the end surface is finished. The remaining pipe material is used in the next installation. After removal of the leader and the propulsion support, the inner surface of the endless buried pipe is finished, the facilities in the shaft are removed, and the shaft is the installed with a manhole, which is same as in the ordinary propulsion process. Meanwhile, since the endless pipe has no axial seam, water sealing process of the axial seam as required in the conventional propulsion process is not necessary, but since there is a seam at the side end of the buried pipe material along the longitudinal direction, this seam part is reinforced or finished if necessary.

When an endless pipe is formed from a long hoop-shaped pipe material and the formed endless pipe is continuously sent into the burying hole and propelled and buried, buried pipes of specific length are not needed. That is, when the long hoop-shaped pipe is prepared in roll or coil form, it is easy to carry in through the shaft, or when the pipe is sent continuously from the shaft into the burying hole, it is not necessary to delivery the entire pipe material into the narrow shaft.

Since the endless buried pipe of the invention is free from an axial seam, it is not necessary to adhere each buried pipe of specified length at the seam or join by using a collar as in the conventional propulsion process. In the endless buried pipe, meanwhile, there is a seam along the side end of the pipe material, but the junction of this seam part can be done continuously as part of the work for fabricating a continuous pipe from a pipe material, and it is not necessary to interrupt the propulsion for joining work, or it is not needed to joining the seam manually as in the conventional propulsion process.

Because there is no seam in the axial direction in the endless buried pipe, the propulsion force applied to the endless buried pipe, the drag force of the ground, or other axial force will not lower the sealing performance of the seam, and breakage of seam is avoided at the same time. In the endless buried pipe, although there is a seam in the longitudinal direction along the side end of the pipe material, the large forces applied to the buried pipes in the propulsion process are mostly the propulsion force, the frictional drag force of the ground and other axial forces, and there is no large force as to open the seam portion along the longitudinal direction of the endless buried pipe. Still more, when the endless pipe is put in the burying hole, it receives pressure in the central direction from the ground, and the force is applied in the direction of firmly bonding the seam along the longitudinal direction of the continuous buried pipe, so that there is no risk of breakage of the junction or leakage of water.

Moreover, by holding and fixing the endless buried pipe on the propulsion support sequentially coupled behind the leader, the endless buried pipe can be held and fixed on the propulsion support at plural positions in the longitudinal direction, and the propulsion force may be transmitted from the propulsion support to the endless buried pipe at these plural holding and fixing positions. As a result, it is not needed to apply the whole propulsion force to the rear end of the endless buried pipe, so that the continuous pipe may be easily propelled in the burying hole directly, while continuously manufacturing continuous pipe from the pipe material. Since the stress occurring in the endless buried pipe is dispersed, an excessive propulsion force is not locally applied to the endless buried pipe, and destruction and deformation may be avoided.

BRIEF DESCRIPTION ON THE DRAWINGS

FIG. 1 is a schematic sectional view of installation state showing an embodiment of the invention, FIG. 2 is a perspective view showing the manufacturing part of an endless buried pipe, FIG. 3 is a partially cut-away sectional view showing the connecting part of the propulsion support and the inflating mechanism in detail, and FIG. 4 is a perspective view showing the manufacturing part of an endless buried pipe in another embodiment.

DESCRIPTION OF THE PREFERRED EMBODIMENTS

Figure 1:
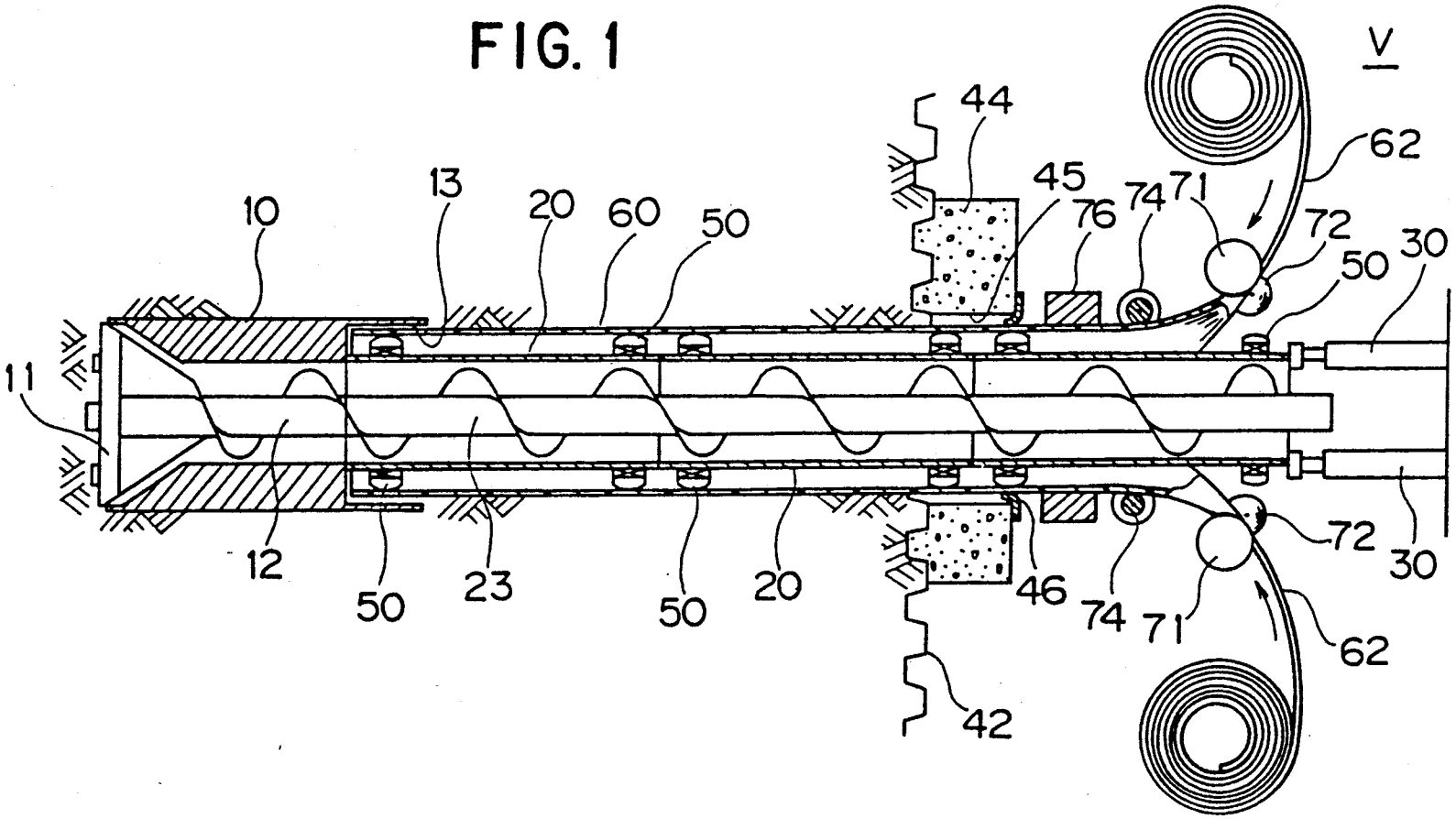

Referring now to the drawings, some of the embodiments of the invention are described in detail below.

FIG. 1 shows a sectional structure of a burying hole of propulsion process.

First, a leader 10 is disposed at the beginning. The leader 10 has a cylindrical outer circumference equivalent to the aperture of the burying hole, and has an auger 11 attached to its front end. The auger 11 excavates the soil while rotating, and the excavated soil is sent out backward by an auger screw 12 installed behind the auger 11. A fitting recess 13 for fitting the front end portion of a continuous buried pipe 60 is formed in the outer circumference of the rear end of the leader 10. A propulsion support 20 is connected to the rear end of the leader 10.

Figure 3:
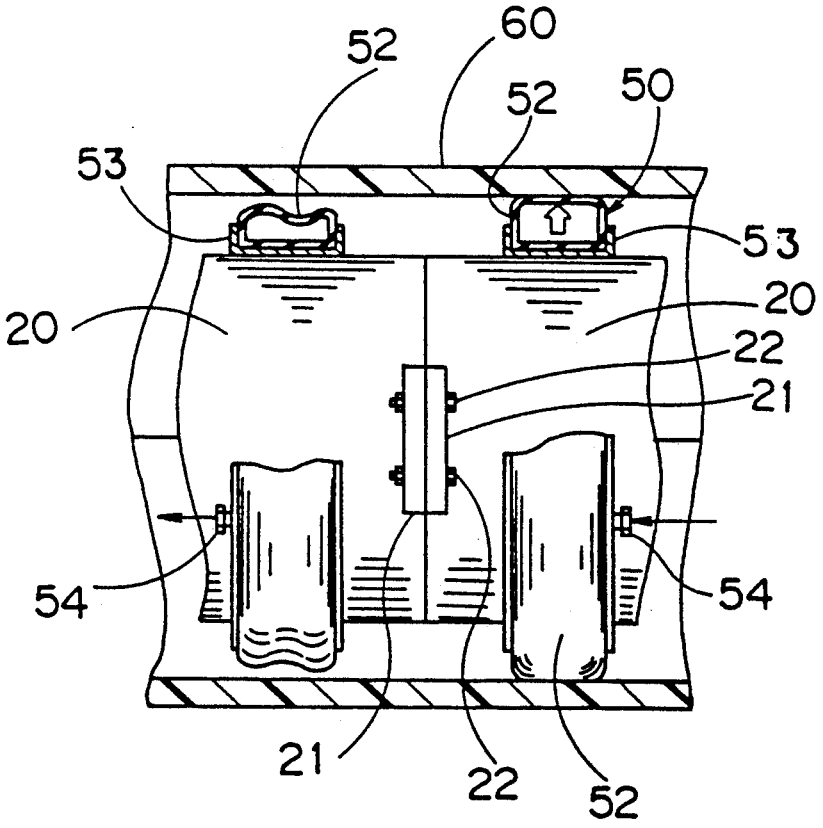

The propulsion support 20 is an axial form made of a steel pipe of fixed length or the like, and it is linked and fixed to the rear end of the leader 10 by means of bolts. The propulsion support 20 is sequentially linked backward. The propulsion supports 20 are mutually coupled by means of, for example, bolts by fixing the flanges 21, 21 disposed at the end surface as shown in FIG. 3. The rearmost end of the propulsion support 20 reaches up to the starting shaft V, and is coupled with the propulsion force applying means, such as jack 30. The inside of the propulsion support 20 is hollow, in which an auger screw 23 is placed. The auger screws 23 are connected sequentially from front to back, and the front end of the auger screw 23 is connected to the auger screw 12 of the leader 10. The soil excavated by the auger 11 of the leader 10 is discharged behind in the shaft V through the auger screws 12 and 23.

On the outer circumference of the propulsion support 20, an circular inflating mechanism 50 is disposed, each near both ends in the axial direction as the holding and fixing means of the endless buried pipe 60. A detailed structure of the inflating mechanism 50 is shown in FIG. 3.

Surrounding the outer circumference of the propulsion support 20, a tubular inflating piece 52 made of elastic material such as rubber is installed. The inflating piece 52 is fixed, with the inner circumference side attached to the support frame 53 attached to the propulsion support 20. The inflating piece 52 has a feed and discharge parts 54 for feeding and discharging a pressure medium such as pressure air or pressure oil. The feed and discharge part 54 may be an ordinary valve for pressure piping or the like. The inflating pieces 52 before and after one propulsion support 20 may be coupled by linking the feed and discharge part 54 mutually with pressure piping, and the inflating pieces 52 of the propulsion support 20 connected before and after may be also coupled with pressure piping.

When pressure medium is introduced into the inflating pieces 52 with the endless buried pipe 60 inserted into the outer circumference of the propulsion support 20, the inflating pieces 52 inflate toward the outer circumference, and the outer surface of the inflating pieces 52 abuts against the inner wall of the endless buried pipe 60, thereby pressing it (the state shown on the right side in FIG. 3). By applying a specific pressure to the endless buried pipe 60 from the inflating pieces 52, a frictional support force is built up between the inflating pieces 52 and endless buried pipe 60, so that the endless buried pipe 60 is securely fixed on the propulsion support 20, without deviating in the axial direction. When the volume or pressure of the pressure air introduced into the inflating pieces is varied, the pressing force to the endless buried pipe 60, that is, the holding and fixing force may be adjusted. By releasing the pressure air introduced into the inflating pieces 52 (the state shown on the left side in FIG. 3), the holding and fixing on the continuous buried pipe 60 is cleared, so that the propulsion support 20 may be drawn out of the endless buried pipe 60.

As the structure of the inflating piece 52, aside from the tube surrounding the outer circumference of the propulsion support 20 as shown in the drawing, other structures may be employed, as far as it abuts against the inner wall of the endless buried pipe 60 to hold and fix, such as the structure of installing a plurality of flat bag-shaped inflating pieces stretching at a specific width along the axial direction of the propulsion support 20 in the circumferential direction of the propulsion support 20 so that the inflating pieces are inflated in the radial direction to abut against the inner wall of the endless buried pipe 60.

As the holding and fixing means of the endless buried pipe 60, when the inflating mechanism 50 as described above is used, the inflating piece 52 elastically abuts against the inner wall of the endless buried pipe 60, so that it is possible to hold and fix securely without damaging or deforming the inner wall of the endless buried pipe 60, and if there is any fluctuation or error in the inside diameter of the endless buried pipe 60, it will be absorbed by the elastic deformation of the inflating piece 52. Besides, there is no complicated operating mechanism, and the risk of trouble is low, and only by controlling the supply of pressure medium, the endless buried pipe 60 may be held, fixed or released easily and securely, and an excellent effect is exhibited.

In the shaft V, at the opening of the burying hole, a soil stop wall 42 and a water stop wall 44 are positioned. Through the central penetration hole 45 of the water stop wall 44, the propulsion support 20 and the endless buried pipe 60 are sent into the burying hole. At the peripheral edge of the penetration hole 45 of the water stop wall, there is a packing member 46 for abutting against the outer circumferential surface of the endless buried pipe 60, and ground water entering the burying hole is prevented from leaking into the shaft V through the penetration hole 45 of the water stop wall.

The endless buried pipe 60 is continuously manufactured from a pipe material 62 placed in the shaft V in the roll state, and is sent into the burying hole. The structure of the block for manufacturing endless buried pipe 60 from the pipe material 62 is particularly shown in FIG. 2.

Figure 2:
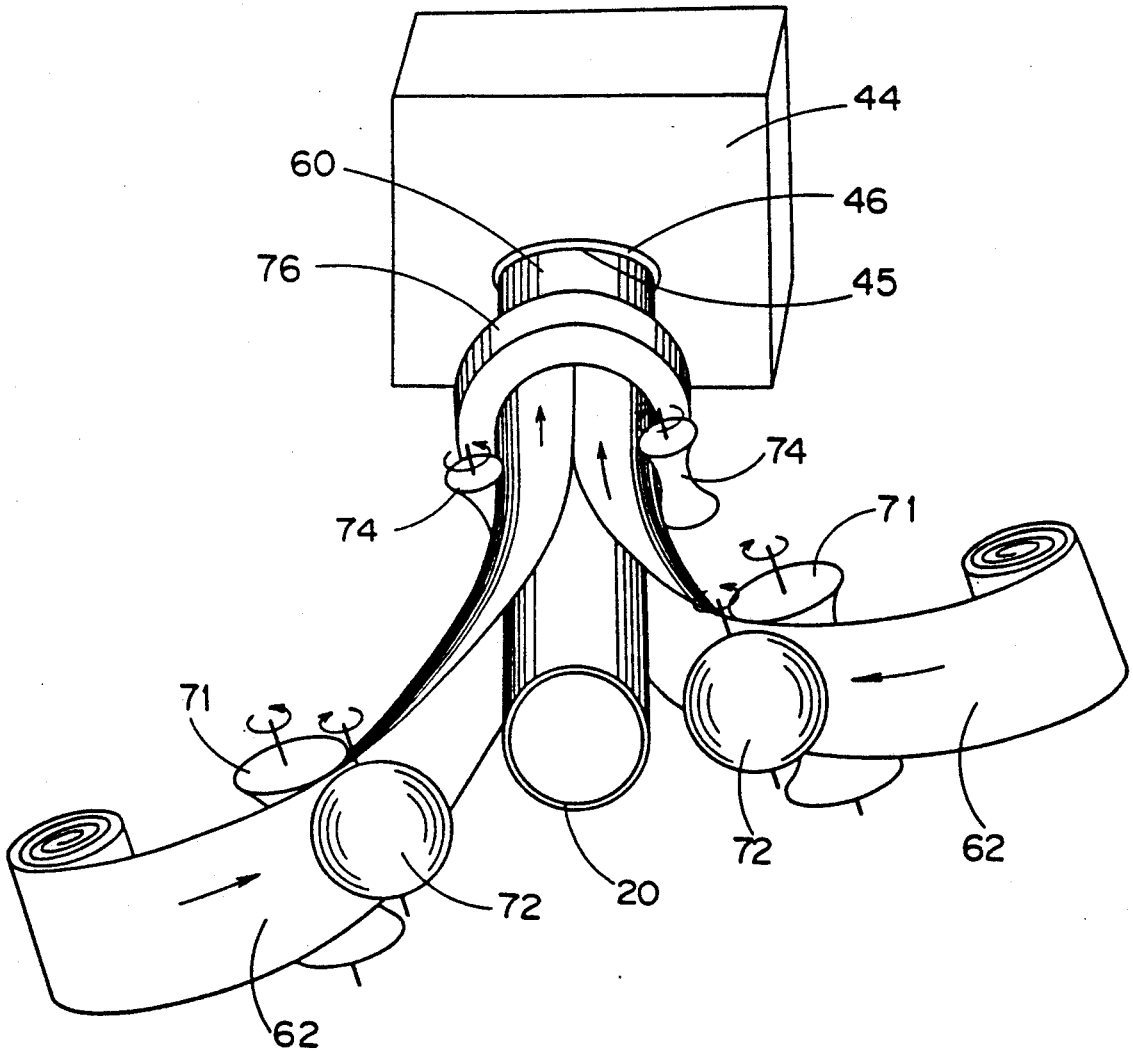

The embodiment shown in FIG. 2 is to manufacture one endless buried pipe 60 by using two pipe materials 62. The pipe material 62 is made of polyethylene resin or the like, and is formed in a flat long hoop and is wound up in a roll for the convenience of handling. Across the center line of the burying hole, two rolls of pipe material 62 are placed symmetrically, and each end of the pipe material 62 is pulled out, and sent into a pair of curving rolls 71, 72. The curving rolls 71, 72 make up a pair of the drum-shaped roll 71 having a recessed arc curvature surface, and the spherical roll 72 having a spherical surface corresponding to the curved surface. As the flat pipe materials 62 pass through the curving rolls 71, 72, they are curved in an arc form. Ahead of the curving rolls 71, 72, there are guide rolls 74, 74 and cylindrical processing device 76. The cylindrical processing device 76 has a curving frame having a processing diameter corresponding to the outside diameter of the continuous buried pipe 60 to be manufactured, and by sending the right and left pipe materials 62 curved to a certain rate in the previous stage into the cylindrical processing device 76, the right and left pipe materials 62 are joined to make a complete cylindrical shape, so that the intended continuous buried pipe 60 shape will be obtained. The side ends in the longitudinal direction of the pipe materials 62, 62 are joined butt to butt, and are thermally adhered by the heating fusion mechanism (not shown) installed in the cylindrical processing device 76. The heating fusion mechanism is in a same structure as the heating fusion mechanism for ordinary synthetic resins. In this embodiment, since two pipe materials 62, 62 are used, longitudinal seams are formed at the upper end and lower end in the drawing. Therefore, the heating fusion mechanisms are placed at the positions corresponding to these seams.

The endless buried pipe 60 sent out from the cylindrical processing device 76 is in a perfectly cylindrical form, and is joined in the seams along the longitudinal direction. Thus fabricated endless buried pipe 60 is held and fixed from the inner side in the holding and fixing mechanism 50 of the propulsion support 20 as shown in FIG. 1, and is propelled inside of the burying hole.

Figure 4:
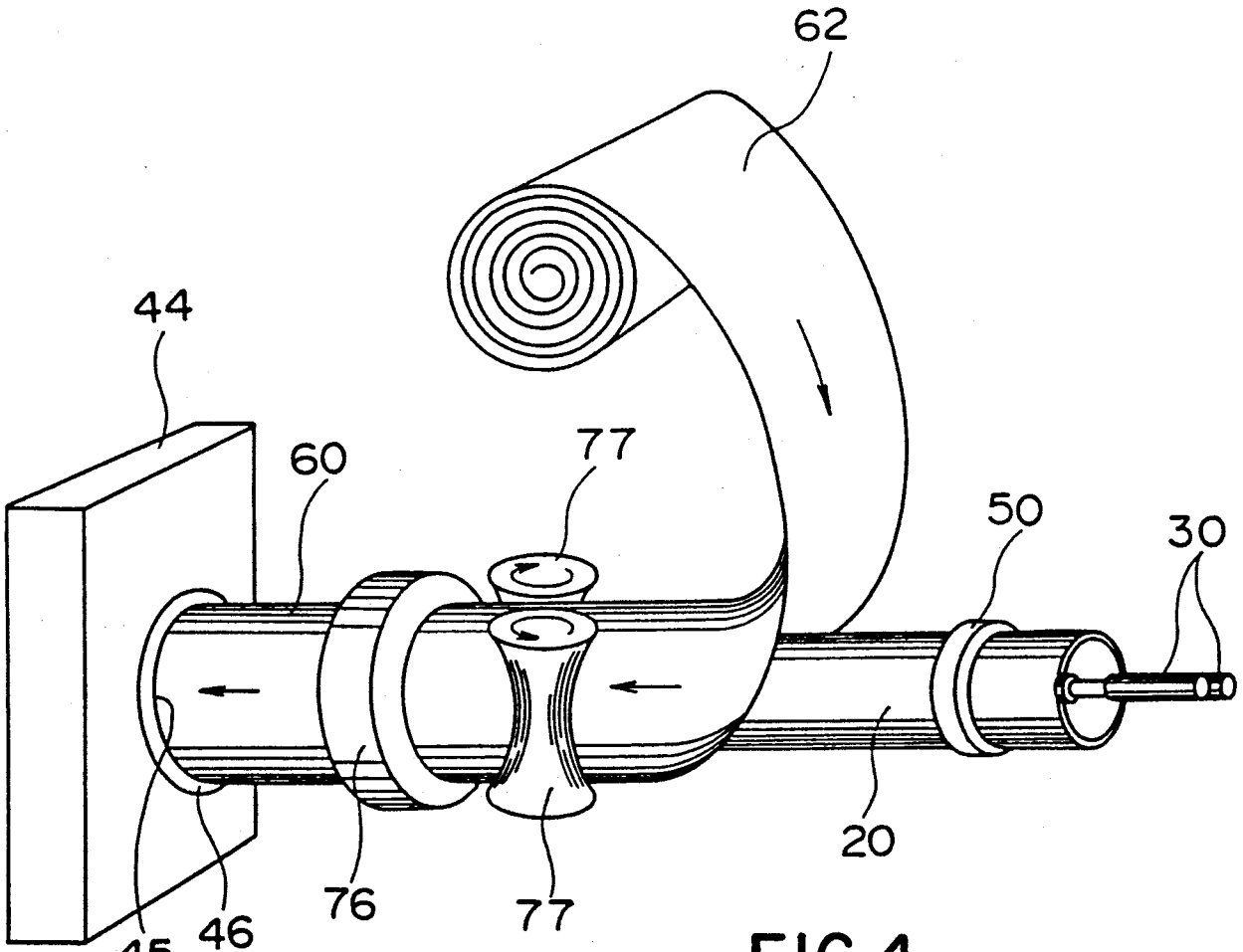

Next, the embodiment shown in FIG. 4 is to manufacture one continuous pipe 60 from one pipe material 62. In this example, ahead of the cylindrical processing device 76, there are a pair of drum-shaped rolls 77, 77 symmetrically across the center line of the burying hole.

The pipe material 62 passes through the drum-shaped rolls 77, 77, and is sent into the cylindrical processing device 76, and an endless pipe 60 is formed same as in the preceding embodiment. Beneath the cylindrical processing device 76, there is a heating fusion mechanism for thermally adhering the side end of the pipe material 62.

The propulsion process by employing the members and the devices described herein is explained below.

The process of forming a burying hole by propelling the leader 10 into the ground from the side of the shaft V is exactly the same as in the ordinary propulsion process. Behind the leader 10, the propulsion supports 20 are extended successively. In the shaft V, the pipe material 62 is sent into the guide roll 72 and cylindrical processing device 76 from the curving rolls 71, 72, and the endless buried pipe 60 is manufactured and propelled into the burying hole. Therefore, the propulsion support 20 gets into the center of the endless buried pipe 60 from the rear open part of the pipe 60. The endless buried pipe 60 sent into the burying hole is sequentially held and fixed by the holding and fixing means 50 of the propulsion support 20.

At the rear end of the propulsion support 20 linked behind the leader 10, a propulsion force is applied by the jack in the shaft, and the leader 10 and the propulsion support 20 are propelled into the ground, and the burying hole is formed by the leader 10. The endless buried pipe 60 held and fixed on the propulsion support 20 is propelled and buried in the burying hole together with the propulsion support 20.

When the leader 10 is propelled up to the intended shaft, the leader 10 and the propulsion support 20 are removed. The propulsion support 20, after releasing the holding and fixing of the endless buried pipe 60 by the holding and fixing means 50, is disassembled into individual pieces and removed. Only the endless buried pipe 60 is left over in the burying hole. At the forward shaft V, the rear end of the endless buried pipe 60 is cut off and separated from the pipe material 62, and the end surface is treated.

Thus is completed the propulsion, burying and installation of the buried pipe, and other practical processes and methods than those described herein are same as in the ordinary propulsion process and are not particularly explained here.

According to the propulsion process of buried pipe of the invention, since an endless pipe is manufactured from a long hoop-shaped pipe material and this endless pipe is continuously sent into the burying hole, there is no seam in the axial direction for connecting pipes of fixed length in the conventional method, and the job for joining the seams in the axial direction is skipped.

As a result, the time and labor for joining the pipes of fixed length may be saved, and defective junction or defective sealing at the seams may be eliminated, and the strength is not lowered at the seams, so that the strength and durability of the entire buried pipe may be enhanced.

Furthermore, when the endless buried pipe is held and fixed by the propulsion support sequentially connected behind the leader, the leader, the propulsion support and endless buried pipe may be securely propelled while continuously manufacturing endless pipe from pipe material and sending the endless pipe into the burying hole. Still more, by holding and fixing the endless buried pipe on the propulsion support, the endless buried pipe may be held and fixed at plural holding positions, and therefore the propulsion force applied to the buried pipe may be dispersed, and local application of excessive force to the buried pipe may be avoided, so that deformation or breakage of the buried pipe in the process of propulsion may be prevented.

What is claimed is:

1. A propulsion process of burying a pipe in a burying hole while forming the burying hole by propelling a leader in the ground, comprising the steps of:

joining at least one propulsion support having pipe supporting means on an external surface thereof to said leader;

extending said propulsion support by joining at least one additional propulsion support to said propulsion support;

providing an endless pipe concentric with an external surface of said propulsion support;

feeding a pressure medium to an inflation mechanism of said pipe supporting means;

expanding said inflation mechanism of said pipe supporting means outward from said propulsion support by said pressure medium;

pressing an outer surface of the inflation mechanism against an internal surface of said endless pipe;

firmly supporting said internal surface of said endless pipe with said pipe supporting means so as to rigidly fix said pipe to said propulsion support;

axially moving said propulsion support by propulsion power to form a burying hole;

successively inserting and propelling said endless pipe into said burying hole; and forming said endless pipe by sequentially curving a pipe material of long hoop shape made of a plastic material.

2. A propulsion process of burying a pipe as claimed in claim 1, further comprising the steps of inserting the endless pipe into an outer circumference of said propulsion support sequentially linked behind the leader, holding and fixing said endless pipe on said propulsion support, and transmitting a propulsion force from said propulsion support to said endless pipe.

* * * * *